US009001487B2

(12) United States Patent
Kim

(10) Patent No.: US 9,001,487 B2
(45) Date of Patent: Apr. 7, 2015

(54) IONIZER

(71) Applicant: Samsung Display Co., Ltd., Yongin, Gyeonggi-Do (KR)

(72) Inventor: Sang-Su Kim, Yongin (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 0 days.

(21) Appl. No.: 14/053,976

(22) Filed: Oct. 15, 2013

(65) Prior Publication Data

US 2014/0268475 A1 Sep. 18, 2014

(30) Foreign Application Priority Data

Mar. 15, 2013 (KR) ..... 10-2013-0028261

(51) Int. Cl.
*H01T 23/00* (2006.01)
*H05F 3/06* (2006.01)

(52) U.S. Cl.
CPC ..... *H05F 3/06* (2013.01)

(58) Field of Classification Search
USPC ..... 361/212, 213, 231
See application file for complete search history.

(56) References Cited

U.S. PATENT DOCUMENTS 3,929,436 A * 12/1975 Kim et al. ..... 96/51
4,757,433 A * 7/1988 Santelmann, Jr. ..... 363/19
6,190,630 B1 * 2/2001 Onizuka et al. ..... 423/243.01

FOREIGN PATENT DOCUMENTS

KR 1999-0003468 A 1/1999
KR 10-2010-0078476 A 7/2010

* cited by examiner

*Primary Examiner* — Danny Nguyen
(74) *Attorney, Agent, or Firm* — Lee & Morse, P.C.

(57) ABSTRACT

An ionizer includes an electrode shaft, a fixing bar, a driver, and a controller. The electrode shaft includes first and second electrode rows, the first electrode row having a plurality of ionizer electrodes arranged in a first direction and the second electrode row having a plurality of ionizer electrodes arranged in the first direction and spaced apart from the first electrode row. The fixing bar includes a discharge area facing an object to be processed, and accommodates the electrode shaft so a single electrode row is disposed in the discharge area. The driver is inside the fixing bar so as to be coupled to both end portions of the electrode shaft, and controls a position of the electrode shaft. The controller controls the driver to replace the electrode row disposed in the discharge area with another electrode row according to a previously input replacement condition.

15 Claims, 2 Drawing Sheets

IONIZER

RELATED APPLICATIONS

Korean Patent Application No. 10-2013-0028261, filed on Mar. 15, 2013, in the Korean Intellectual Property Office, entitled "Ionizer," is incorporated herein by reference in their entirety.

BACKGROUND

1. Field

Embodiments relate to an ionizer.

2. Description of the Related Art

In manufacturing and assembling of an electronic component, e.g., a semiconductor substrate, if a mechanism or the like for handling electronic components is charged with static electricity, particles such as dust may be attached to the electronic component, or a circuit in the electronic component may be damaged due to discharge.

In order to solve such a problem, a static electricity removing device called an ionizer is used to neutralize an object to be processed by emitting ionized air onto the object charged with static electricity. The ionizer has ionizer electrodes that inject, into a neutralization region, positive or negative ions generated by corona discharge when a high voltage is applied to the ionizer electrodes. As a result, static electricity included in the neutralization region is removed by the positive or negative ions.

DC or AC corona discharge is generally used to generate the ionized air. For example, a corona discharge type ionizer generates corona discharge by respectively applying high positive and negative voltages with about ±20 kV to positive and negative needle-type electrodes. Thus, air around the electrodes is ionized into positive and negative ions, and the ionized ions are carried with the flow of indoor air, so that electric charges charged to a charged body are neutralized into reverse polarity ions in the air.

The ionizer can be used for a wafer mounting or substrate transfer process in a semiconductor fabricating process. However, the ionizer electrodes may be corroded due to corona discharge thereof, and particles may be generated due to the occurrence of whitening. In this case, particle elements become a major source of the particles generated in a space inside a frame. Therefore, the particle elements have bad influence on a wafer and cause a failure of the wafer.

SUMMARY

One or more embodiments are directed to an ionizer, including an electrode shaft having a first and second electrode rows. The first electrode row has a plurality of ionizer electrodes arranged in one direction. The second electrode row has a plurality of ionizer electrodes arranged in one direction and spaced apart from the first electrode row; a fixing bar having a discharge area facing an object to be processed, and accommodating the electrode shaft so that any one electrode row is disposed in the discharge area; a driver provided to an inner surface of the fixing bar so as to be coupled to both end portions of the electrode shaft, and rotating or ascending/descending the electrode shaft; and a controller controlling the driver to replace the electrode row disposed in the discharge area with another electrode row according to a previously input replacement condition of the ionizer electrodes.

The electrode shaft may be rotationally symmetric, e.g., a cylinder in which a plurality of electrode rows may be radially provided on an outer circumferential surface of the electrode shaft.

The driver may include a rotary portion coupled to both the end portions of the electrode shaft so as to rotate the electrode shaft. The driver may include an ascending/descending portion provided to the inner surface of the fixing bar so as to vertically move the rotary portion.

The controller may control the ascending/descending portion to move the electrode shaft to the rear of the discharge area by a predetermined distance when the first electrode row is replaced. The controller may control the rotary portion to rotate the moved electrode shaft by a predetermined angle so that the second electrode row faces the discharge area. The controller may control the ascending/descending portion to move the rotated electrode shaft to the front of the discharge area so that the second electrode row is disposed in the discharge area.

The ionizer may further include an air supply unit supplying air to the fixing bar with a predetermined pressure.

The fixing bar may include at least one air hole formed adjacent to the discharge area and spraying the air supplied from the air supply unit.

The fixing bar may include a front surface in which the discharge area is formed, a side surface extended in a direction perpendicular from the front surface so as to form an accommodation space, and a rear surface opposite to the front surface and having an insertion hole that accommodates the electrode shaft.

The discharge area formed in the front surface of the fixing bar may be shaped to accommodate a single electrode row.

The ionizer may further include a voltage application unit applying a high voltage to the electrode row disposed in the discharge area of the fixing bar.

The electrode shaft and the driver may be attachable/detachable.

The ionizer electrodes may be made of a material including at least one of acetal, acrylonitrile butadiene styrene (ABS), polycarbonate (PC), polybutylene terephthalate (PBT), stainless steel, aluminum alloy and plastic.

The ionizer may further include a display unit displaying replacement conditions of the electrode row.

The replacement condition may be a predetermined replacement period.

DETAILED DESCRIPTION

Figure 1:
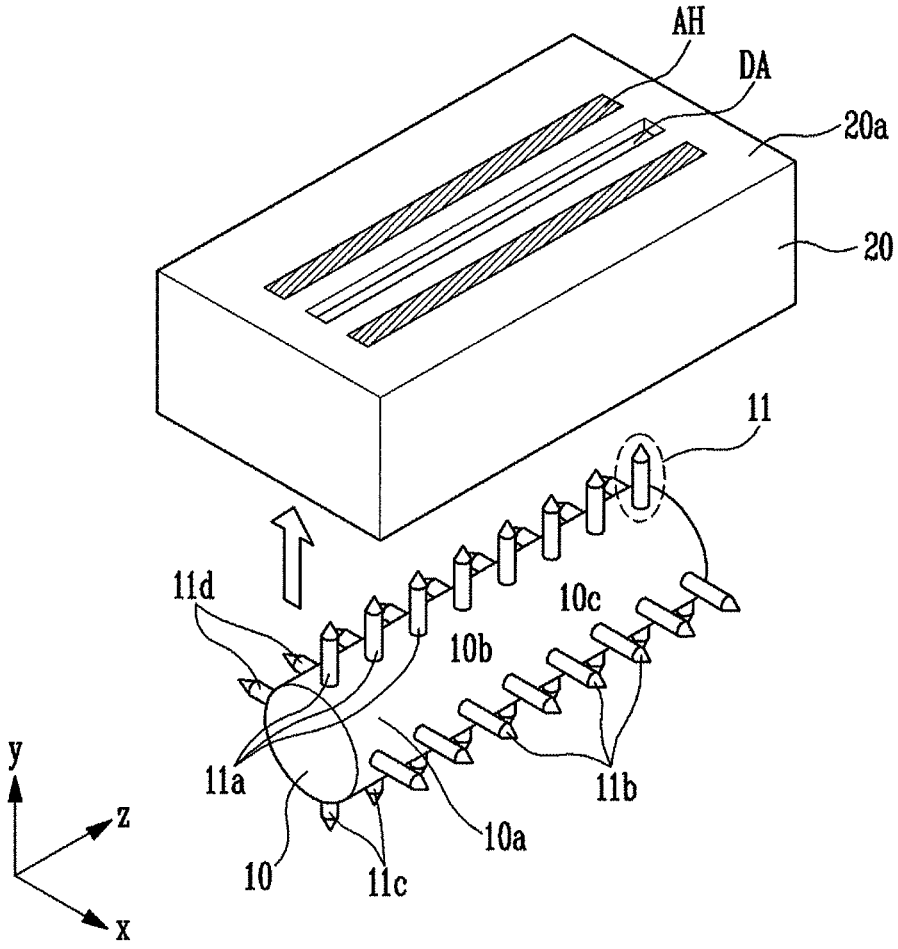
FIG. 1 is a perspective view schematically illustrating an embodiment of an ionizer.
Figure 2A:
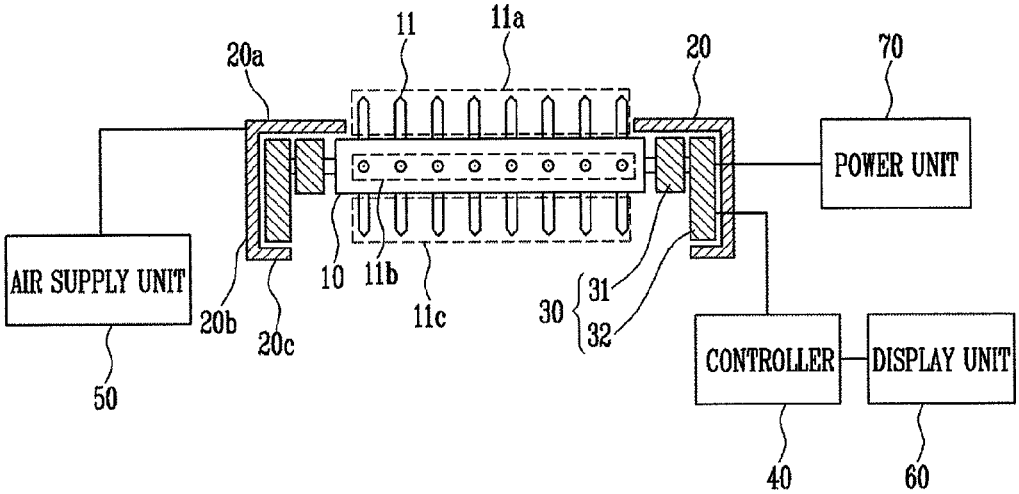
FIGS. 2A and 2B are sectional views illustrating an operation of replacing an electrode row in the ionizer of FIG. 1.
Figure 2B:
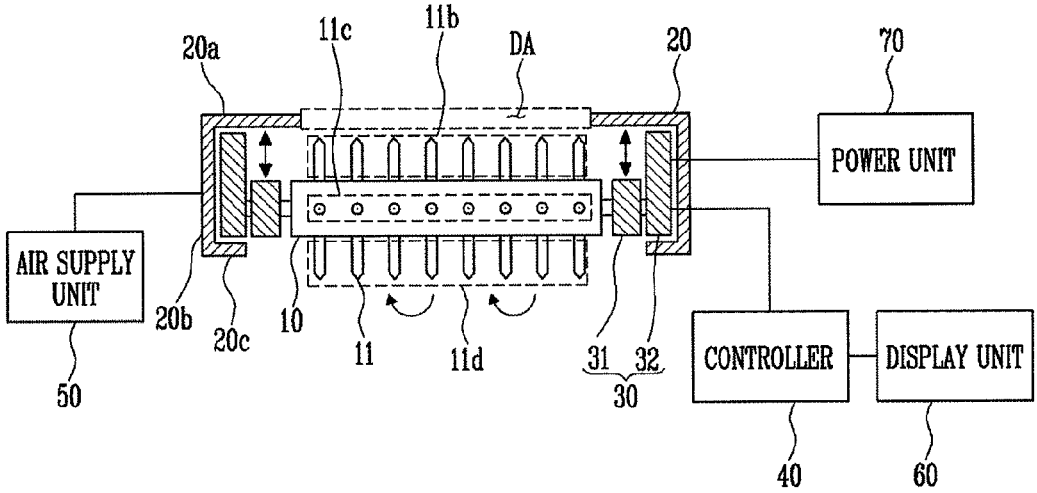

FIG. 1 is a perspective view schematically illustrating an ionizer according to an embodiment. FIGS. 2A and 2B are sectional views illustrating an operation of replacing an electrode row in the ionizer of FIG. 1.

The ionizer of the present embodiment may be provided in a semiconductor substrate transfer system, and an object, e.g., a semiconductor substrate, to be processed, which may be an object subjected to static electricity removal. Specifically, the ionizer emits ionized air onto a substrate transferred while being mounted at an upper portion a substrate transfer line including a conveyor belt or roller, thereby neutralizing static electricity on the substrate.

Referring to FIGS. 1, 2A, and 2B, the ionizer includes an electrode shaft 10, a fixing bar 20, a driver 30, and a controller 40. The ionizer may further include an air supply unit 50, a display unit 60, and a power unit 70.

The electrode shaft 10 includes a first electrode row 11*a*, on which a plurality of ionizer electrodes are arranged in a first direction, e.g., the z-direction extending along a length of the electrode shaft 10, while extending along a second direction, e.g., along the y-direction, and a second electrode row 11*b*, on which a plurality of ionizer electrodes 11 are arranged in the first direction while being spaced apart from the first electrode row 11*a* and extending along a third direction, e.g., along the x-direction.

The electrode shaft 10 may be radially symmetric along the z-direction, e.g., may have a cylindrical shape, and a plurality of electrode rows may be radially provided on an outer circumferential surface 10*a* of the electrode shaft 10. For example, the electrode shaft 10 may further include third and fourth electrode rows 11*c* and 11*d* together with the first and second electrode rows 11*a* and 11*b*. The first to fourth electrode rows 11*a*, 11*b*, 11*c*, and 11*d* are arranged in a radial pattern about the center axis passing through the electrode shaft in the length direction, e.g., the z-direction. The number and arrangement of the electrode rows may be variously modified as long as the electrode row is easily replaceable according to the rotation of the electrode shaft 10.

Each ionizer electrode 11 extends from the outer circumferential surface 10*a* of the electrode shaft 10, e.g., along the y or x direction. The ionizer electrode 11 receives a high voltage applied and generates corona discharge, thereby producing ions. Corona discharge refers to a phenomenon that atoms or molecules in the air are ionized by an electric field generated when a high DC or AC voltage is applied to an end portion 11', e.g., a needle-shaped emission tip. For example, the end portion 11' of the ionizer electrode 11 may be formed in the shape of a triangular pyramid in order to effectively generate corona discharge.

For example, if a high AC voltage is applied to the ionizer electrode 11, positive (+) and negative (−) ions in the air are basically produced in the same quantity. If the positive and negative ions are emitted onto a charged object to be processed, the object to be processed absorbs reverse polarity ions by repelling ions with the same polarity as the object to be processed.

Accordingly, if the reverse polarity ions contact the object to be processed, the quantity of electric charges charged in the object is decreased, and thus the same quantity of positive (+) and negative (−) ions contact each other. The object to be processed becomes equilibrium at a low potential so as to be neutralized.

The ionizer electrode 11 may be made of a material including at least one of acetal, acrylonitrile butadiene styrene (ABS), polycarbonate (PC), polybutylene terephthalate (PBT), stainless steel, aluminum alloy and plastic. However, the number, material, and shape of the ionizer electrode 11 may be variously modified, and embodiments are not limited thereto.

A voltage application unit 10*b* and a switching unit 10*c* may be provided inside the electrode shaft 10. The voltage application unit 10*b* applies a high voltage to the ionizer electrode 11 and the switching unit 10*c* selectively applies a voltage to any one of the first to fourth electrode rows 11*a*, 11*b*, 11*c*, and 11*d*.

The fixing bar 20 is a case that accommodates the electrode shaft 10 therein. The fixing bar 20 is fixed to a portion of a substrate processing system so that any one of the electrode rows 11*a*-11*d* faces the substrate that is an object subjected to static electricity neutralization. Specifically, the fixing bar 20 has a discharge area DA facing the substrate, and accommodates the electrode shaft 10 so that any one of the electrode rows may be disposed in the discharge area DA.

For example, the fixing bar having a bar shape may be configured to include a front surface 20*a* in which the discharge area DA is formed, a side surface 20*b* extended in a direction perpendicular from the front surface 20*a* so as to form an accommodation space, and a rear surface 20*c* opposite to the front surface 20*a* and having an insertion hole of the electrode shaft 10.

Here, the shape of the fixing bar 20 may be variously modified. In all configuration, the fixing bar 20 has an accommodation space in which the electrode shaft 10 accommodated in the fixing bar 20 can be moved at a predetermined distance and rotated to replace the electrode row.

The discharge area DA formed in the front surface 20*a* of the fixing bar 20 may be opened in the shape of a long hole so that any one of the electrode rows is inserted into the long hole. That is, only any one electrode row positioned in the discharge area DA among the plurality of electrode rows 11*a*, 11*b*, 11 *c*, and 11*d* provided to the electrode shaft 10, e.g., the first electrode row 11*a* is exposed to the outside of the fixing bar 20, and the second to fourth electrode rows 11*b*, 11*c* and 11*d* are covered by the fixing bar 20, thereby preventing contamination and damage from the outside.

The fixing bar 20 may include at least one air hole AH formed adjacent to the discharge area DA and sprays air supplied from the air supply unit 50. Generally, the fixing bar 20 is mounted while being spaced apart from the substrate, which is an object to be processed, at a predetermined distance. In this case, the air hole AH adjacent to the discharge area DA can improve static electricity removing efficiency as a ventilation means for effectively transferring ionized air to the substrate.

The driver 30 is provided to the inner surface of the fixing bar 20 so as to be coupled to both end portions of the electrode shaft 10 and to rotate and/or ascend/descend the electrode shaft 10. The driver 30 is a mechanical device for replacing the electrode row positioned in the discharge area DA by driving the electrode shaft 10 under the control of the controller 40.

Specifically, the driver 30 may include a rotary portion 31 coupled to both the end portions of the electrode shaft 10 so as to rotate the electrode shaft 10, and an ascending/descending portion 32 provided to the inner surface of the fixing bar 20 so as to vertically move the rotary portion 31.

The rotary portion 31 may rotate the electrode shaft 10 by the angle of 90 degrees in its original place, and the ascending/descending portion 32 may vertically move the rotary portion 31 in a sliding manner. Although not shown in these figures, the rotary portion 31 and the ascending/descending portion 32 may include a motor for generating dynamic power, a belt, and a plurality of pulleys or gears.

The driver 30 is fixed inside the fixing bar 20, but may be configured to be easily separated from and coupled to the electrode shaft 10. The controller 40 is electrically connected to the ionizer electrodes 11 and the driver 30, and controls the driver 30 so that one electrode row disposed in the discharge area DA is replaced with another electrode row according to a previously input replacement condition of the ionizer electrodes 11.

The replacement condition may be a replacement period of the ionizer electrodes 11 determined based on discharge time and/or the number of processes. The controller 40 automatically decides the replacement period previously input by a user so that the electrode row can be replaced. Alternatively or additionally, the replacement condition may be based on damage to the electrode row being used.

For example, assume that the replacement period of the ionizer electrodes 11 is set to 70 hours. When the use time of the first electrode row 11*a* disposed in the discharge area DA reaches 70 hours, the controller 40 controls the ascending/descending portion 32 to move the electrode shaft 10 and the rotary portion 31 connected to the electrode shaft 10 to the rear of the discharge area DA by a predetermined distance. Here, the movement distance to the rear of the discharge area DA is sufficient as long as the movement distance is a distance at which the first electrode row 11*a* is not interrupted when rotating inside the fixing bar 20.

Next, the controller 40 controls the rotary portion 31 to rotate the moved electrode shaft 10, e.g., by 90 degrees, to a next electrode row, e.g., 11*b*, so that the second electrode row 11*b* faces the discharge area DA. Next, the controller 40 controls the ascending/descending portion 32 to move the rotated electrode shaft 10 to the front of the discharge area DA, so that the second electrode row 11*b* disposed in the discharge area DA.

In a process of removing static electricity, after the electrode row is replaced, the controller 40 controls the voltage application unit 10*b* and the switching unit 10*c* provided inside the electrode shaft 10 to apply a high voltage to the second electrode row 11*b*. Additionally, in a process of replacing the electrode row, the controller 40 is required to inform the replacement of the substrate processing system so that the process is stopped for a predetermined time.

The controller 40 is illustrated as being included in the ionizer, but may be a portion of a control device for generally operating the substrate processing system including the ionizer. The controller 40 may include an electronic control unit (ECU) or micro control unit (MCU). The controller 40 may further include units for performing data storage, numerical operation, signal amplification and noise filtering, or may be connected to units separately provided to the outside.

The air supply unit 50 supplies air to the fixing bar 20 with a predetermined pressure, and may include a supply line (not shown) and an air pump (not shown), which are connected to the air hole AH via the fixing bar 20.

The display unit 60 displays information on the replacement time and replacement condition of the ionizer electrodes so that a user easily checks the replacement period or other damage indicator and performs management of equipment. The display unit 60 may display various messages transmitted from the controller 40. The display unit 60 may inform the user, using a character, sound, warning lamp, or the like. The display unit 60 may be mounted to a side portion of the fixing bar 20 or may be implemented through a separate monitoring device electrically connected to the controller 40. The display unit 60 may be configured together with the controller 40.

The display unit 60 may further include a predetermined interface (not shown) such as a touch pad, touch screen, keyboard or mouse. The kind, position, shape, and size of the display unit 60 may be variously modified when necessary, and embodiments are not limited thereto.

The power unit 70 is a voltage supply source for supplying power to the ionizer electrodes 11 via the fixing bar 20. Since the ionization rate of the ionizer electrode 11 is in proportion to a voltage applied to the ionizer electrode 11, a large-capacity voltage supply source is preferably used as the power unit 70.

As described above, according to embodiments, the ionizer has a plurality of ionizer electrode rows, and one electrode row disposed in a discharge area is replaced with another electrode row according to a previously input replacement condition of the ionizer electrodes, so that it is possible to automatically replace the ionizer electrodes and to minimize the number and time of shutdowns of a processing facility, caused by the replacement, thereby improving productivity. Further, the ionizer may include a display unit for displaying replacement conditions of the electrode rows, thereby more efficiently managing the ionizer electrodes.

In contrast, previous solutions to corroded ionizer electrodes included periodic cleaning to prevent particle contamination caused by corrosion of the ionizer electrodes. However, productivity is lowered due to the shutdown of a processing facility for cleaning, and human power and time are required to perform maintenance and repair operations such as cleaning and replacement of the ionizer electrodes. Further, the replacement time and cleaning period of the ionizer electrodes are occasionally performed by worker's passive and subjective decision, which results in inconvenience and inefficiency.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. An ionizer, comprising:

an electrode shaft including first and second electrode rows, the first electrode row having a plurality of ionizer electrodes arranged in a first direction and the second electrode row having a plurality of ionizer electrodes arranged in the first direction and spaced apart from the first electrode row;

a fixing bar including a discharge area facing an object to be processed, the fixing bar accommodating the electrode shaft so that any one electrode row is disposed in the discharge area;

a driver inside the fixing bar so as to be coupled to both end portions of the electrode shaft, the driver controlling a position of the electrode shaft; and a controller controlling the driver to replace the electrode row disposed in the discharge area with another electrode row according to a previously input replacement condition.

2. The ionizer of claim 1, wherein the electrode shaft is rotationally symmetric.

3. The ionizer of claim 2, wherein the electrode shaft is a cylinder and a plurality of electrodes rows including the first and second electrode rows are radially provided on an outer circumferential surface of the electrode shaft.

4. The ionizer of claim 2, wherein the driver includes a rotary portion coupled to both the end portions of the electrode shaft so as to rotate the electrode shaft.

5. The ionizer of claim 4, wherein the driver includes an ascending/descending portion provided to the inner surface of the fixing bar so as to vertically move the rotary portion.

6. The ionizer of claim 5, wherein the controller:

controls the ascending/descending portion to move the electrode shaft to the rear of the discharge area by a predetermined distance when the first electrode row is replaced, controls the rotary portion to rotate the moved electrode shaft by a predetermined angle so that the second electrode row faces the discharge area, and controls the ascending/descending portion to move the rotated electrode shaft to the front of the discharge area so that the second electrode row is disposed in the discharge area.

7. The ionizer of claim 5, wherein the electrode shaft and the driver are attachable/detachable.

8. The ionizer of claim 1, further comprising an air supply unit supplying air to the fixing bar with a predetermined pressure.

9. The ionizer of claim 8, wherein the fixing bar includes at least one air hole adjacent to the discharge area and spraying air supplied from the air supply unit.

10. The ionizer of claim 1, wherein the fixing bar includes a front surface in which the discharge area is formed, a side surface extending from the front surface so as to form an accommodation space, and a rear surface opposite to the front surface and having an insertion hole that accommodates the electrode shaft.

11. The ionizer of claim 10, wherein the discharge area is shaped to accommodate a single electrode row.

12. The ionizer of claim 11, further comprising a voltage application unit applying a high voltage to the electrode row disposed in the discharge area of the fixing bar.

13. The ionizer of claim 1, wherein the ionizer electrodes is made of a material including at least one of acetal, acrylonitrile butadiene styrene (ABS), polycarbonate (PC), polybutylene terephthalate (PBT), stainless steel, aluminum alloy, and plastic.

14. The ionizer of claim 1, further comprising a display unit displaying replacement conditions of the electrode row.

15. The ionizer of claim 1, wherein the replacement condition is a predetermined replacement period.

* * * * *